US011835279B2

(12) United States Patent
Matthews et al.

(10) Patent No.: US 11,835,279 B2
(45) Date of Patent: Dec. 5, 2023

(54) NOISE REDUCTION METHOD

(71) Applicant: OXFORD INSTRUMENTS NANOTECHNOLOGY TOOLS LIMITED, Abingdon (GB)

(72) Inventors: Anthony J. Matthews, Abingdon (GB); Mark Patton, Abingdon (GB); Jeremy White, Abingdon (GB)

(73) Assignee: Oxford Instruments Nanotechnology Tools Limited, Oxon (GB)

( * ) Notice: Subject to any disclaimer, the term of this patent is extended or adjusted under 35 U.S.C. 154(b) by 305 days.

(21) Appl. No.: 17/266,664

(22) PCT Filed: Aug. 7, 2019

(86) PCT No.: PCT/GB2019/052219
§ 371 (c)(1),
(2) Date: Feb. 8, 2021

(87) PCT Pub. No.: WO2020/030910
PCT Pub. Date: Feb. 13, 2020

(65) Prior Publication Data

US 2021/0310710 A1 Oct. 7, 2021

(30) Foreign Application Priority Data

Aug. 8, 2018 (GB) ..... 1812894

(51) Int. Cl.
*F25B 49/02* (2006.01)
*F25B 9/14* (2006.01)

(52) U.S. Cl.
CPC ..... *F25B 49/022* (2013.01); *F25B 9/145* (2013.01); *F25B 2309/1427* (2013.01);
(Continued)

(58) Field of Classification Search
CPC ..... F25B 49/022; F25B 9/145; F25B 2309/1427; F25B 2500/12; F25B 2500/13; F25B 2600/0253
See application file for complete search history.

(56) References Cited

U.S. PATENT DOCUMENTS

2008/0104966 A1* 5/2008 Stautner ..... G01R 33/31 62/51.1
2014/0245757 A1 9/2014 Garside et al.
(Continued)

FOREIGN PATENT DOCUMENTS

EP 2 856 043 A2 4/2015
GB 2504187 A 1/2014
(Continued)

OTHER PUBLICATIONS

Kaneuma, Sheet Beam Type Inspection Apparatus, 2007, Full Document (Year: 2007).*
(Continued)

*Primary Examiner* — Nael N Babaa
(74) *Attorney, Agent, or Firm* — Blank Rome LLP

(57) ABSTRACT

There is provided a method of reducing noise in a cryogenic cooling system associated with a mechanical refrigerator forming part of said cooling system. The method comprises: monitoring vibrations in the cooling system during operation of the mechanical refrigerator; and modulating an operating frequency of the mechanical refrigerator based on the monitored vibrations so as to reduce the amplitude of said vibrations. This allows noise within the cooling system to be reduced.

20 Claims, 6 Drawing Sheets

(52) U.S. Cl.
CPC ..... *F25B 2500/12* (2013.01); *F25B 2500/13* (2013.01); *F25B 2600/0253* (2013.01)

(56) References Cited

U.S. PATENT DOCUMENTS

| | | | | |
|---|---|---|---|---|
| 2014/0325999 | A1* | 11/2014 | Hope | F25D 19/006 62/6 |
| 2016/0195347 | A1* | 7/2016 | Monaco | F28F 27/00 165/11.2 |
| 2017/0009762 | A1* | 1/2017 | Lilie | F04B 39/0005 |
| 2018/0216853 | A1 | 8/2018 | Nezuka et al. | |

FOREIGN PATENT DOCUMENTS

| | | | | | |
|---|---|---|---|---|---|
| JP | 2000 199653 | | | 7/2000 | |
| JP | 2000199653 | A | | 7/2000 | |
| JP | 2003262417 | A | | 9/2003 | |
| JP | 2007165327 | A | * | 6/2007 | G01N 23/225 |
| JP | 2009536514 | A | | 10/2009 | |
| JP | 2016114006 | A | | 6/2016 | |
| JP | 201737052 | A | | 2/2017 | |
| JP | 2017058050 | A | | 3/2017 | |
| JP | 2017207270 | A | | 11/2017 | |
| WO | 2013168206 | A1 | | 11/2013 | |

OTHER PUBLICATIONS

Translation of Mar. 20, 2023, Office Action issued in connection with Japanese Patent Application No. 2021-506638.

Office Action with English translation dated Aug. 21, 2023 in corresponding Japanese Patent Application No. 2021-506638.

* cited by examiner

NOISE REDUCTION METHOD

RELATED APPLICATIONS

This application is a U.S. National Stage Application of International Application No. PCT/GB2019/052219, filed on Aug. 7, 2019, which claims priority of Great Britain Application No. 1812894.2, filed on Aug. 8, 2018. The entire contents of those applications are incorporated herein by reference.

FIELD OF THE INVENTION

The present invention relates to noise reduction in cryogenic cooling systems. This is with the intention of reducing noise associated with a mechanical refrigerator coupled to such a cooling system.

BACKGROUND

There are a number of experiments and procedures conducted at cryogenic temperatures, such as at temperatures lower than 77 Kelvin (K) or temperatures around or below 4 K. In the past, cryogenic fluids such as liquid nitrogen and liquid helium have been used to achieve these temperatures. These fluids were typically produced in dedicated liquefaction plants (featuring powerful mechanical compressors and expansion stages) and then transported (in liquid form) to the experimental region where their cooling power (also referred to as cooling capacity, i.e. their ability to provide cooling) was consumed. There was, therefore, a separation between the "production" and "consumption" of cold sources and the associated "noise" generated during the production process of a cold source. However, there is now a desire to achieve such temperatures while also keeping the use of these cryogenic fluids to a minimum, and where possible avoiding their use completely.

This has resulted in the use of mechanical refrigerators as a replacement or supplement to using cryogenic fluids. There are many configurations of such mechanical coolers, and they operate at a range of temperatures: for example a single stage Gifford-McMahon or Pulse Tube mechanical cooler can provide cooling power at temperatures below 80 K; and a double stage Gifford-McMahon or Pulse Tube mechanical cooler can provide cooling power at temperatures below 4 K. However, due to the use of motors to drive many types of mechanical refrigerators, the use of mechanical refrigerators causes additional noise within the cooling system in which they are placed. This is undesirable because, often, the experiments and procedures run in a mechanically refrigerated cooling system are highly sensitive and therefore require noise to be kept to a minimum to avoid disruption and errors in data.

Similar concerns apply to the attainment of "ultra"-low temperatures (typically temperatures below 1 K). Starting with liquefied Helium-4 ($^4$He) it is possible in principle to attain ultra-low temperatures without needing to incorporate mechanical elements, for example the vapour above a volume containing liquid $^4$He can be reduced with an adsorption pump to cool below 1 K. With this, a volume of Helium-3 ($^3$He) can be condensed and a second adsorption pump is able to be used to pump vapour from the $^3$He and therefore cool to below 300 milliKelvin (mK). Similar concepts (albeit for more complex arrangements) can be used to demonstrate that dilution refrigerators can be constructed that cool to temperatures below 100 mK without any mechanical elements. However, it is often desirable to couple mechanical elements, such as external, mechanical, pumps to ultra-low temperature systems to either simplify their construction and/or operation, or to attain higher performance. In such a configuration, such ultra-low temperature systems can also be considered as mechanical refrigerators, and may themselves be coupled to other mechanical refrigerators (possibly of different configurations, and operating at different temperatures), such as pulse tube coolers to realise "cryogen-free" ultra-low temperature systems.

As a range of mechanical coolers are available, much of the following can be simplified by considering how it applies to a specific realisation of such a cooler, such as a double stage pulse tube cooler (i.e. a 3 K cooler, or, in other words a refrigerator or cooler capable of cooling down to temperatures of about 3 K). However, it should be clear that the points described are generally applicable to other types of mechanical refrigerator as well.

It is often considered by the users of mechanical refrigerators (such as 3 K mechanical refrigerators) that the standard motor supplied with a mechanical refrigerator is the primary source of noise generated by the mechanical refrigerator. These mechanical refrigerators are driven using electrical motors. While the electrical motors in themselves can be a source of electrical noise, they commonly also generate noise induced by mechanical vibrations which is a focus of here.

The period at which the mechanical refrigerator is driven by this motor can introduce noise through mechanical vibrations into the system. Microphonics in experimental wiring generated by these vibrations can couple into experimental wiring connected to sensitive samples, resulting in electrical noise within a measurement circuit.

In order to provide an environment within which the vibration levels are minimized as far as possible for experiments and procedures that are sensitive to noise generated in such a manner, such as those that relate to quantum computing a means of reducing noise is needed.

SUMMARY OF INVENTION

According to a first aspect of the invention, there is provided a method of reducing noise in a cryogenic cooling system, the noise being associated with a mechanical refrigerator forming part of said cooling system, the method comprising: monitoring vibrations in the cooling system during operation of the mechanical refrigerator; and modulating an operating frequency of the mechanical refrigerator based on the monitored vibrations so as to reduce the amplitude of said vibrations.

A significant source of noise in the highly sensitive experiments and procedures that are now being conducted is due to vibrations caused in the cooling system within which the experiments and procedures are being conducted. We have found that these vibrations are caused by coupling of harmonics of the mechanical refrigerator operating frequency and structural resonances of the cooling system. Additionally, we have found that by modulating the operating frequency of the mechanical refrigerator, the noise levels in the cooling system and the system as a whole (should other components be attached to the cooling system) can be significantly reduced without raising the minimum temperature that the mechanical refrigerator is able to achieve. As an example, for a pulse tube refrigerator operating at around 3 K, the minimum temperature was not perturbed by more than about 0.3 K, but the amplitude of vibrations, which cause noise within the cooling system are able to be reduced by about 50%. We have found that this level of noise reduction can also apply to other mechanical refrigerators cooling, such as mechanical refrigerators cooling to a minimum temperature of about 3 K.

Modulating the operating frequency of mechanical refrigerators alters the thermal performance of the mechanical refrigerator, for example by altering the maximum attainable cooling power and/or minimum temperature that can be reached by the mechanical refrigerator. This has therefore previously been considered undesirable because the primary aim of a mechanical refrigerator is to cool to the lowest possible temperature as efficiently and quickly as possible. We have found however, that the amount of noise reduction indicated above can be achieved whilst avoiding altering the minimum temperature. Using the example of a 3 K mechanical refrigerator, we found that the minimum temperature is able to achieved whilst avoiding altering this temperature by more than about 0.1 K. Consistent with the points above, we have also found that this reduction in temperature alteration can also apply to other mechanical refrigerators, such as mechanical refrigerators cooling to a minimum temperature of about 3 K.

The noise being monitored may be noise associated with a plurality of mechanical refrigerators. Typically however, the noise being monitored may be noise associated with only a single mechanical refrigerator. This allows vibrations caused by the single mechanical refrigerator to be minimised by modulating the operating frequency of the single mechanical refrigerator. In situations where there are multiple coolers operating, one strategy is to simply ensure that no two coolers are operating at the same frequency. This is in order to try to avoid "doubling" the noise at that frequency (for example due to superpositioning of vibrations). This can be achieved by simply monitoring the operating frequencies of each cooler and ensuring none are equal). This is not what is described herein. Instead, by measuring that an actual amplitude of vibration is in the final system the entire "transfer function" from the each vibrating element to the complete system can considered. Indeed, it may be the case that detuning slightly two components could result in beating being produced at a much lower frequency that more severely impacts the overall vibration amplitude of the complete system. Such behaviour can be detected and corrected when the overall vibration amplitude can be measured.

By the phrase "modulating the operating frequency" we intend to mean that the operating frequency of the mechanical refrigerator is at least adjusted from a first frequency to a second frequency. This is intended to encompass at least a single adjustment from a first frequency to a second frequency, a continual switching back and forth between a first and second frequency, causing the operation of the mechanical refrigerator to pulse, such as by switching between operating and not operating, or adjusting the first frequency to a second frequency to at least one or more further frequencies sequentially across a frequency spectrum. Modulating the operating frequency comprising adjusting the operating frequency from a first frequency to a second frequency provides a simple and efficient process for reducing noise.

There are commonly many components of a mechanical refrigerator that have the potential to generate noise, such as vibrations. Accordingly, the operating frequency of any component of a mechanical refrigerator that is driven and capable of causing vibrations may be modulated in order to modulate the operating frequency of the mechanical refrigerator. Typically however, modulating the operating frequency of the mechanical refrigerator comprises modulating the operating frequency of a driving motor of the mechanical refrigerator.

The driving motor in a mechanical refrigerator defines the fundamental frequency at which vibrations are generated and by modulating the frequency of this motor the fundamental frequency of the mechanical cooler can be adjusted. However, since the driving motor has an effect on the cooling power and minimum temperature attainable by a mechanical refrigerator, adjusting the operating frequency of the driving motor has previously been undesirable. We have found that modulating the operating frequency of the driving motor allows the mechanical refrigerator's contribution to vibration levels within the system as a whole to be altered, creating a greater benefit than the associated disadvantage of detrimentally affecting the thermal performance of the mechanical refrigerator.

The drive motor may be any form of motor, although typically the driving motor is a stepper motor. This may also apply for a 3 K pulse tube cooler. Preferably, the step rate of the stepper motor is controllable. The driving motor being a stepper motor allows the amount of rotation applied to the mechanical refrigerator by the motor to be controlled, and the step rate of the stepper motor being controllable allows the rotational frequency (which corresponds to the driving frequency of the motor) to be altered.

The drive motor may drive any drivable component of the mechanical refrigerator. Typically, the driving motor drives a rotary valve of the mechanical refrigerator during the operating of the mechanical refrigerator. Many mechanical refrigerators use rotary valves as a key part of their cooling mechanism. Accordingly, the driving motor driving the rotary valve causes the modulation of the operating frequency of the driving motor to cause a modulation of the operating frequency of the mechanical refrigerator. This extends the vibration reduction capabilities to reduction of vibrations generated by the mechanical refrigerator coupling into the structural resonances of the system as a whole. In line with this, typically, the operating frequency is the frequency at which the rotary valve rotates when in use. This may also apply for a 3 K pulse tube cooler.

Preferably, the operating frequency may be between about 1.20 Hz and about 1.90 Hz. Still more preferably, the operating frequency may between about 1.30 Hz and 1.50 Hz. Typically, when modulating the operating frequency, the operating frequency is modulated within one of these frequency ranges. This keeps the effect of the frequency modulation on the thermal performance of the mechanical refrigerator to a minimum. This may also apply for a 3 K pulse tube cooler.

The mechanical refrigerator may be any form of mechanical refrigerator such as a Stirling refrigerator, a Gifford-McMahon (GM) refrigerator or a dilution refrigerator, for example, operable with an external pressure pump and/or a compressing system. However, typically the mechanical refrigerator is a Pulse Tube refrigerator (PTR, also referred to as a pulse tube cooler). It is preferable to use PTRs in experiments and procedures that are highly sensitive. This is because the only physical moving part of a PTR (other than the working fluid contained inside) is the rotary valve. As such, using a PTR as the mechanical refrigerator allows the method to be applied in highly sensitive environments to allow high quality data to be produced by keeping noise to a minimum since most of the noise will be caused by vibrations generated by motion of the PTR's rotary valve. The PTR may be a 3 K PTR.

Whilst some realisations of dilution refrigerators may be considered not to be mechanical refrigerators, dilution refrigerators are included in the above list of mechanical refrigerators that may be used in the first aspect. This is because, as set out above, mechanical components that assist with the cooling provided by such a refrigerator may be coupled to the dilution refrigerator during its use. This means dilution refrigerators have mechanical components and therefore fall within the intended meaning of mechanical refrigerators applicable for the first aspect. Further, the use of such external components with dilution refrigerators is similar to the use of external components for other mechanical refrigerators, such as PTRs. For example, 4 K mechanical refrigerators (such as PTRs) usually operate using $^4$He as a working fluid. Some specialist PTRs have also been constructed using $^3$He to attain lower temperatures (although these are "research demonstrators" rather than for practical use). The $^4$He is supplied to the system from an external compressor arrangement whereby an oscillating "high" and "low" pressure regime is imposed to promote the motion of $^4$He within the refrigerator. In a comparable manner, dilution refrigerators rely on the motion of $^3$He within the refrigerator, but in a continuous (rather than oscillating) flow. Often an external "low" and "high" pressure pumping/compressing system is employed to promote this flow. This external system for handling the $^3$He may consist of, for example, a turbo molecular pumps (often with typical rotational frequencies of about 500 Hz to 900 Hz), rotary pumps (often with typical rotational frequencies of about 30 Hz to 70 Hz), and compressor pumps (often with typical rotational frequencies of about 30 Hz to 70 Hz). Any of these frequencies could couple to vibrational modes of the cooling system in the manner describe herein, and the impact may also be mitigated in a similar way of any mechanical refrigerator of the attached system. For example, adjusting the operating speed of a turbo pump from 820 Hz to 819 Hz would have no practical impact on its pumping speed, but could ensure it is not operating at a resonant frequency (or some harmonic of a resonant frequency). Therefore typically, the applicable mechanical refrigerators usable with the cooling system may include only the mechanical refrigerators listed in the previous paragraph.

In a first alternative, the operating frequency may be modulated by a user based on the monitored vibrations. This allows the user to select how much to modulate the frequency and what modulation is to be applied.

In a second alternative, the operating frequency may be modulated automatically based on the monitored vibrations. This allows the operating frequency to be modulated based on continuous feedback. This enables the operating frequency to be modulated to take into account any changes in the monitored vibrations should any be detected while vibrations are monitored. Accordingly, frequency modulation is able to be applied dynamically in reaction to changes in the monitored vibrations caused by changes in the cryogenic cooling system.

Modulation of the operating frequency may be achievable because the displacement signal of the mechanical refrigerator that is being monitored may be used as a feedback signal to modulate the operating frequency of the mechanical refrigerator. By the phrase "displacement signal", it is intended to mean the detected signal produced by vibrations thereby causing displacement due to the amplitude of the vibrations. Additionally, by the phrase "feedback signal" it is intended to mean the feedback that is provided to allow the operating frequency to be modulated. By using the displacement signal as a feedback signal, we account for the full transfer function of the system and optimise its performance directly.

Vibrations causing noise may be monitored by any known method of monitoring vibrations. Typically, the vibrations are monitored by a probe placed in contact with the cooling system. This allows direct interaction between the cooling system in which the vibrations occur and the system and the system as a whole for monitoring the vibrations.

The probe may be any kind of sensor that is capable of monitoring vibrations. Typically though, the probe is an accelerometer. Using an accelerometer is simpler to use than other displacement sensors, such as geophones or optical sensors. This is because we found using an accelerometer was easier to use and more robust than other sensors, as well as being suitable for use at room temperature and under vacuum at cryogenic temperatures.

The probe may be placed in contact with any part of the cooling system, such as a frame, or in contact with a sample. Typically, the probe is placed in contact with a cryostat comprised by the cooling system. This allows the probe to be placed on the exterior of the cryostat meaning that it does not need to be able to withstand cryogenic temperatures or temperature cycling. This also allows the probe to be placed in contact with the largest component of the cooling system in which most vibrations will be detectable.

Alternatively, the vibrations may be monitored by a probe placed in contact with a cooling target of the cooling system. This makes it possible to monitor any additional user equipment, such as a user's experiment, that would be the target of any cooling being applied within the cooling system if the user equipment is sensitive to vibrations. This would allow such sensitivity to be taken into account when modulating an operating frequency in order to further optimise the conditions for the equipment.

Typically, the operating frequency may be modulated to substantially de-couple at least one harmonic of the operating frequency of the mechanical refrigerator from a structural resonance of the cooling system and the system as a whole. When a mechanical refrigerator operating frequency harmonic has a similar frequency to a frequency of a structural resonance of the cryogenic cooling system, the harmonic and the structural resonance couple. This causes an amplified vibration within the cooling system due to the structural resonance being driven by the coupled harmonic. This increased vibration amplitude can couple into electrical measurement lines through microphonics which can generate noise within a measurement circuit. De-coupling the at least one harmonic and the structural resonance reduces the amplification and therefore reduces the noise.

Preferably the at least one harmonic of the operating frequency and the structural resonance of the cooling system may be substantially de-coupled by adjusting the operating frequency of the mechanical refrigerator. By adjusting the mechanical refrigerator operating frequency, the difference in frequency between the harmonic and the structural resonance is able to be increased, de-coupling the harmonic and the structural resonance. As mentioned above, this reduces the amplitude of any vibration produced due to the harmonic and structural resonance coinciding.

Adjustment of the mechanical refrigerator operating frequency may be achieved by monitoring amplitude of peaks based on Full Width Half Maximum (FWHM) analysis of a structural resonance or harmonic peak, or by monitoring a specific separation of peaks. Typically, the operating frequency is adjusted across a frequency range to identify the frequency at which the resonance and/or harmonic peaks are at a minimum and selecting that frequency. This may be achieved through monitoring vibration amplitudes, such as by monitoring an output of vibrations across a frequency range and identifying when the vibrations are at a minimum. It would also be possible to monitor peaks corresponding to structural data in measurement data if the user's equipment is sensitive to vibrations.

Preferably, the operating frequency may be adjusted by at least 0.01 Hz. We have found this allows a suitable degree of de-coupling of a harmonic and structural resonance to be achieved.

According to a second aspect of the invention, there is provided a frequency adjuster, comprising: a vibration detector adapted in use to monitor vibrations in a cryogenic cooling system; and a controller adapted to control an operating frequency of a mechanical refrigerator forming part of the cooling system, wherein the operating frequency is modulated using the controller based on monitored vibrations by the vibration detector so as to reduce the amplitude of said vibrations.

Preferably, the frequency adjuster is adapted to perform the method according to the first aspect.

According to a third aspect of the invention, there is provided a cryogenic cooling system comprising: a cryostat; a mechanical refrigerator coupled to said cryostat; and a frequency adjuster according to the second aspect adapted in use to monitor vibrations in the cryostat and modulate an operating frequency of the mechanical refrigerator.

BRIEF DESCRIPTION OF FIGURES

Examples of a noise reduction method and a corresponding frequency adjuster and cryogenic cooling system are described in detail below, with reference to the accompanying figures, in which.

DETAILED DESCRIPTION

We now describe an example of a noise reduction method, along with a description of an example cryogenic cooling system including an example frequency adjuster.

Figure 1:
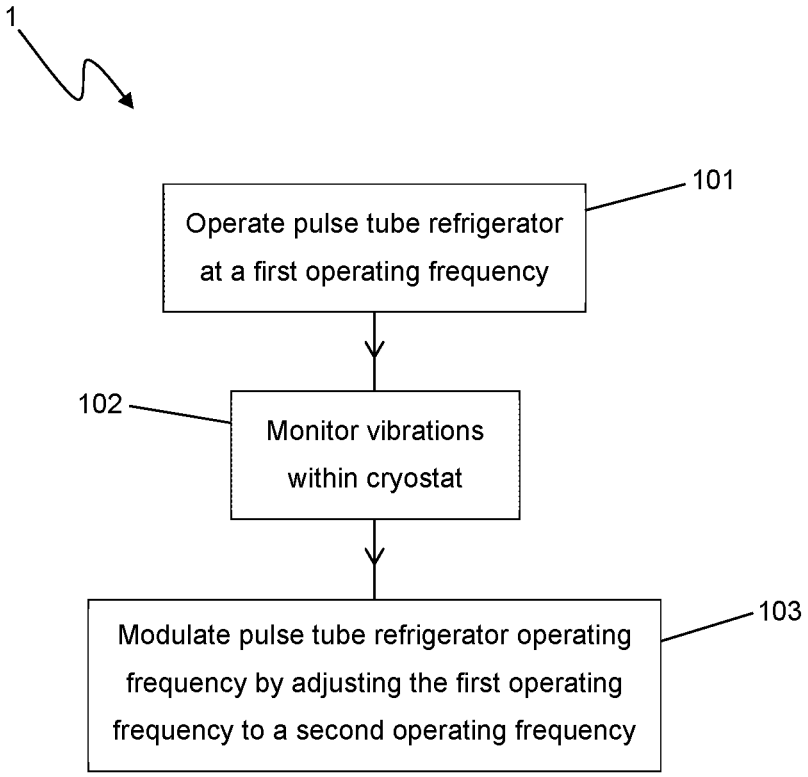
FIG. 1 shows a flow diagram of an example noise reduction method.
Figure 2:
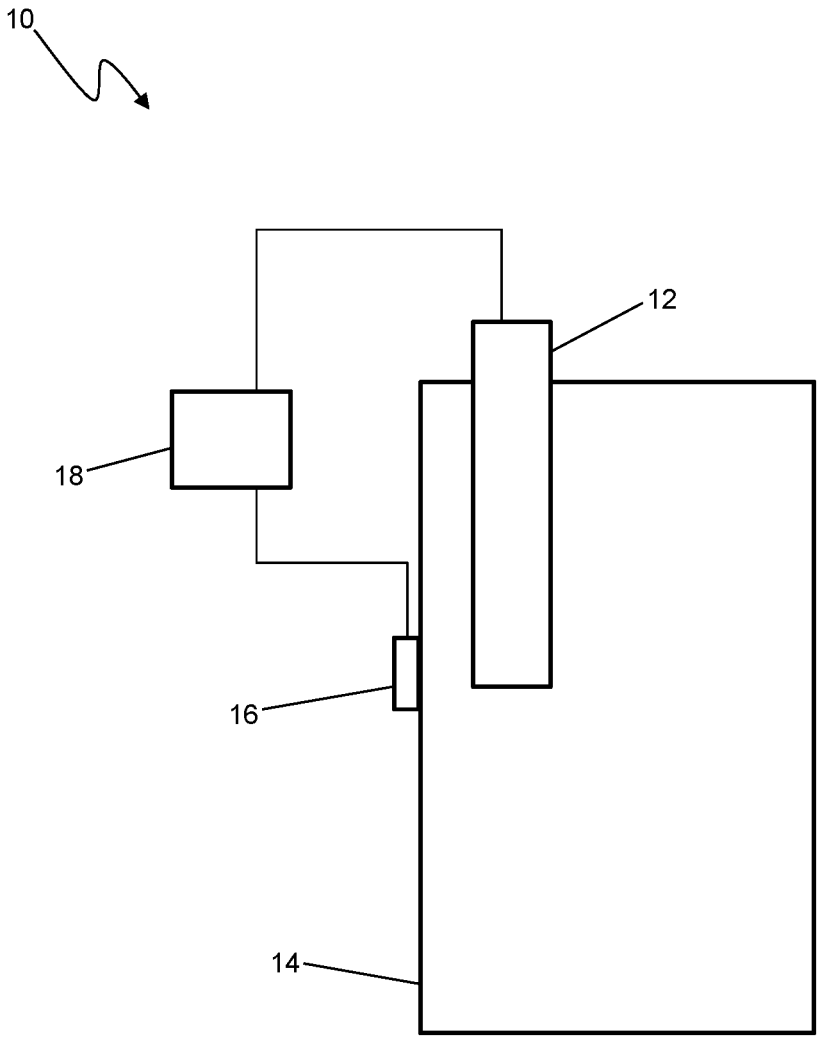
FIG. 2 shows a schematic view of an example cryogenic cooling system.

Referring now to FIG. 1 and FIG. 2, a process of a first example noise reduction method is illustrated generally at 1 in FIG. 1 and an example cryogenic cooling system is illustrated generally at 10 in FIG. 2.

In the cryogenic cooling system 10, a pulse tube refrigerator (PTR) 12 is coupled to a cryostat 14. The cryostat is typically mounted in a support frame (not shown). An accelerometer 16 is in contact with the cryostat and is connected to a controller 18 to which the accelerometer outputs data. The accelerometer and the controller make up the frequency adjuster.

At step 101, the PTR 12 is operated at a first operating frequency. This is achieved by operating a rotary valve (not shown) in the PTR at the first operating frequency. Additionally, the PTR typically has external components coupled to it. An example of such a component is an external compressor used to oscillate high and low pressures to promote motion of the $^4$He working fluid within the PTR. A further example of an external component is a pump or pumping system. External components coupled to the PTR (or to any other mechanical refrigerator of other examples) typically vibrate while operating and therefore, since they are coupled to the PTR, contribute to the operating frequency of the PTR.

The PTR 12 is operated to cool a cooling target (not shown) in the cryostat 14 to an operational temperature of about 3.5 K to 4.0 K. Once the cooling target has reached the operational temperature, in step 102, vibrations within the cryostat are monitored. This is achieved using the accelerometer 16 in contact with the cryostat. This allows vibrations that cause displacement within the cryostat to be observed across a frequency spectrum.

The cooling target may be further cooling stages (not shown), such as a dilution refrigerator, a $^3$He circuit or a $^4$He circuit. These provide further cooling to lower temperatures, such as to about 0.01 K. Vibrations caused by these further cooling stages are significantly less than the vibrations caused by the PTR 12 or another mechanical refrigerator. It would of course be possible for any contribution to vibrations within the system of such further cooling stages to be monitored and taken into account.

As noted above, the PTR 12 has a first operating frequency. Due to the coupling of the PTR to the cryostat 14, the operation of the PTR at this frequency causes a primary vibration within the cryostat at this frequency due to mechanical motion of the PTR caused by the operation of the rotary valve. In addition to the primary vibration caused by the PTR directly due to the first operating frequency, secondary vibrations are caused in the cryostat. The secondary vibrations are each vibrations at higher frequencies than the first operating frequency caused by harmonics of the first operating frequency. The harmonics are generated in part because the mechanical oscillations of the PTR generated by the operation of the rotary valve are not sinusoidal.

Additionally, the cryostat 14 has its own structural resonances due to the natural frequency vibration of the cryostat. This is at least in part due to normal modes of oscillation of the cryogenic cooling system and its various components including the cryostat. The vibrations are able to be output to a display (not shown). When a structural resonance coincides or is close to a harmonic of the PTR's operating frequency, the resonance and the harmonic couple. The coupling causes a vibration within the cryostat of a greater amplitude than the amplitude of the respective independent vibrations that would have been caused by each of the resonance or the harmonic if they were de-coupled.

The output from the accelerometer 16 provides readings of the vibrations caused by the harmonics and structural resonances on a frequency spectrum. The readings that are output are the magnitude of vibrations at respective frequencies within a frequency range. Based on the output from the accelerometer, at step 103, the first operating frequency of the PTR 12 is modulated by adjusting the first operating frequency to a second operating frequency. This is achieved by the controller 18 causing the operating frequency of the PTR 12 to alter. Additionally, in examples where external components coupled to the PTR are taken account of as part of the operating frequency of the PTR, modulation is also able to be applied to those components to adjust the frequency of the vibrations they cause and therefore modulate their contribution to the operating frequency. This also applies to examples using alternative mechanical refrigerators.

By changing the operating frequency of the PTR 12, the frequency of the harmonics changes. Even a small change, such as a change of about 0.1 Hz to 0.5 Hz is sufficient to limit the extent to which any harmonic of the operating frequency couples to a structural resonance of the cryostat 14. This reduces the total amount of vibration within the cryostat thereby reducing the noise experienced by any sample at the cooling target. To avoid increasing the vibration levels when modulating the operating frequency of the PTR, the vibrations caused by the second operating frequency can be monitored in the same way as the vibrations caused by the first operating frequency. Should the vibrations be increased by the second operating frequency, the further adjustments can be made to the frequency. However, this will likely be unnecessary since it is possible to tell the effect on the vibrations of a change from the first operating frequency to a second operating frequency by reviewing the output of the accelerometer 16 while adjusting the operating frequency.

Other factors also have to be taken into account when modulating the operating frequency of the PTR 12. One such factor is the thermal performance of the PTR. As mentioned above, PTRs typically have an operating frequency of about 1.40 Hz. This is because the lowest operating temperature and greatest cooling power is able to be achieved at about this operating frequency. However, we have discovered that PTR operating frequencies between about 1.20 Hz and about 1.90 Hz can be used to drive a PTR without having too detrimental an effect on the minimum temperature that is able to be achieved. This can be seen from FIG. 3, which shows a plot of the temperature of the coldest part of the PTR compared to the rotary valve frequency.

Figure 3:
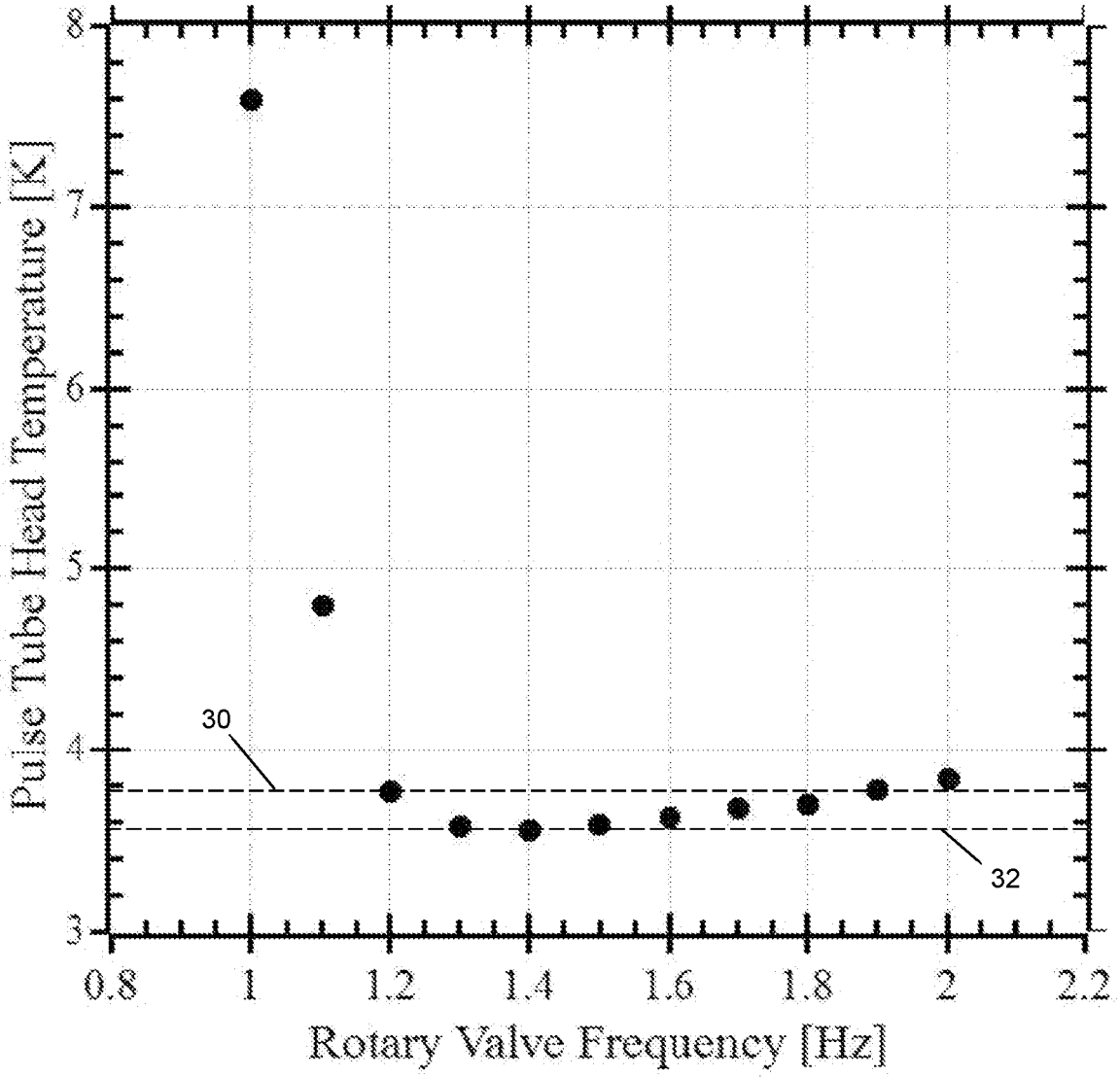
FIG. 3 shows a plot of operational temperature of an example pulse tube refrigerator against frequency of the pulse tube refrigerator rotary valve.

From FIG. 3, it can be seen that at 1.20 Hz, the PTR head temperature is about 3.8 K (indicated by line 30 in FIG. 3); at 1.40 Hz, the PTR head temperature is about 3.6 K (indicated by line 32 in FIG. 3); and at 1.90 Hz, the PTR head temperature is about 3.8 K (again indicated by line 30 in FIG. 3). These are the maximum and minimum temperature values within this frequency range. Accordingly, it is still possible for the PTR to provide cooling to temperatures below 4.0 K while operating at a frequency other than 1.40 Hz. When choosing an operating frequency over a more limited range than 1.20 Hz to 1.90 Hz, the range in PTR head temperatures reduces. For example, in the operating frequency range of 1.30 Hz to 1.50 Hz, the range in temperature is less than 0.1 K as can be seen from FIG. 3.

Outside of the frequency range of 1.20 Hz to 1.90 Hz however, the PTR head temperature increases significantly. This can be seen from FIG. 3, which shows that below a frequency of 1.20 Hz, the PTR head temperature increases to about 7.6 K at a frequency of 1.00 Hz. At a frequency of 2.00 Hz, the temperature increase of the PTR head is less significant. However, there is still an increase in the PTR head temperature, and, although not shown in FIG. 3, the temperature continues to increase as the frequency increases.

Figure 4:
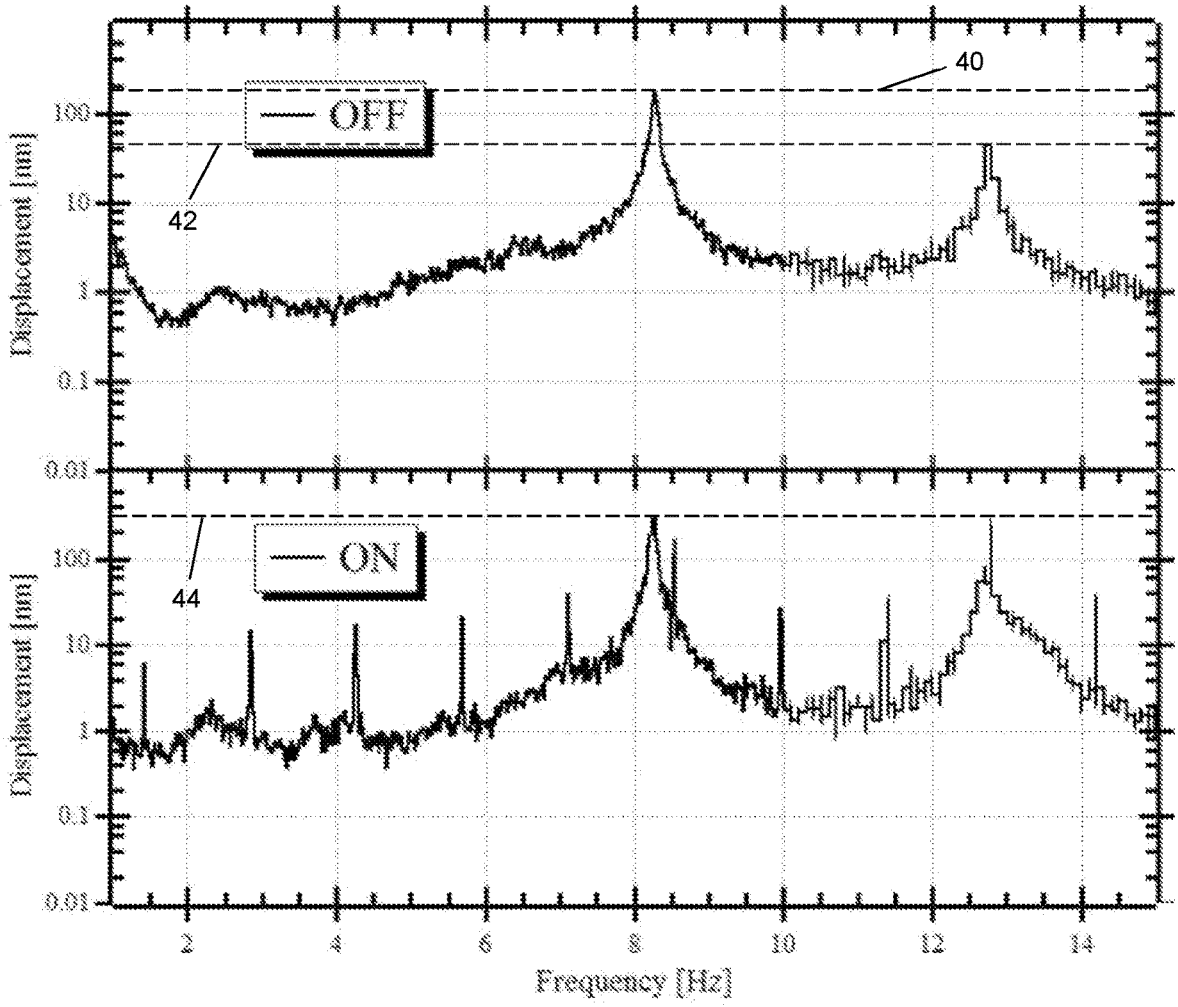
FIG. 4 shows a comparative plot of vibrations in an example cryogenic cooling system across a frequency spectrum when a pulse tube refrigerator is operating and when the pulse tube refrigerator is not operating.

The effect on the vibrations within the cryostat 14 when operating the PTR 12 coupled to the cryostat is shown by FIG. 4. This shows two plots comparing the output of the accelerometer 16 when the PTR is not operating with the output of the accelerometer when the PTR is operating at an operating frequency of 1.40 Hz.

Each of the plots show that the cryostat used in generating the plots has a structural resonance at about 8.00 Hz and at about 13.00 Hz. This is indicated by the respective peak shown at each of these frequencies in each plot. While the peaks at the structural resonances are the primary features on the plot showing the accelerometer's 16 output when the PTR is not operating, the plot showing the accelerometer's output when the PTR is operating shows further peaks. These peaks are shown at regular intervals across the frequency spectrum shown in FIG. 3. These peaks at regular intervals represent vibrations caused by the PTR at the operating frequency of the PTR and at the operating frequency harmonics at each multiple of the operating frequency. Further, it can be seen from this plot that a respective harmonic coincides with each of the structural resonance at about 8.00 Hz and about 13.00 Hz causing the respective harmonic and respective structural resonance to couple.

As indicated by line 40, the peak at about 8.00 Hz when the PTR 12 is not operating shows that vibrations at this frequency cause a displacement of about 100 nanometres (nm). The peak at about 13.00 Hz when the PTR 12 is not operating shows that vibrations at this frequency cause a displacement of about 40 nm, as indicated by line 42. In comparison, the plot of the accelerometer output when the PTR is operating shows that the peak at about 8.00 Hz and the peak at about 13.00 Hz each have a displacement amplitude of at least 300 nm due to the coupling of the respective harmonic and respective structural resonance. This is indicated by line 44 in FIG. 4. These measurements were taken using an accelerometer located on an exterior of a top plate of the system, and therefore not in a cooled region and not in an environment in which a vacuum is applied.

For the structural resonance at about 13.00 Hz, the increase in displacement amplitude from about 40 nm to at least 300 nm is an increase of at least 750 percent (%). While smaller, the increase in the displacement amplitude of the structural resonance at about 8.00 Hz from 100 nm to at least 300 nm is an increase of at least 300%. As set out above, the reason for these increases in displacement amplitude is that harmonics of the PTR operating frequency couple with the structural resonances of the cryostat. This leads to high amplitude vibrations within the cryostat relative to the other vibrations present in the cryostat when PTR is operating. We have discovered that these vibrations cause noise in data being output from an experiment or procedure being run in the cryostat, which significantly affects high sensitivity experiments and procedures.

An example of an arrangement that would be affected by the motion within the cryostat caused by the coupling of harmonics of the PTR operating frequency to structural resonances in the cryostat is one that uses superconducting magnets. Arrangements such as these are affected because the motion causes eddy currents to be induced in the sample due to sample movement being produced relative to the magnetic field generated. These in turn cause heating of the sample, which will impact on the measurements that can be made. Another example of a vibration sensitive arrangement is free space optical measurements of a sample. In such a situation, an optical source or detector being used to carry out the optical measurements external to the sample is not fixed in position relative to the sample, so movement of the sample relative to the external optical source or detector would affect the data collected. Thus, minimising such movement induced by vibrations would improve the quality of data collected.

To reduce the magnitude of the vibrations, the cryogenic cooling system needs to be "de-tuned" such that the structural resonances no longer coincide with the harmonics of the PTR operating frequency. This causes a de-coupling of the harmonic and structural resonance thereby reducing amplification of the vibrations caused by the structural resonances and the harmonics.

This is able to be achieved by adjusting the operating frequency of the PTR. This allows an approximate de-tuning can be applied during manufacture and installation followed by a more accurate de-tuning by the user if they consider it necessary once they have added anything they want to into the cryostat. This is achieved by the controller 18 being programmable to modulate the operating frequency of the PTR coupled to the cryostat.

By modulating the operating frequency of the PTR, the optimum operating frequency can be selected. A demonstration of this can be seen in FIG. 5. This shows plots of vibration amplitudes in a cryostat with a structural resonance at about 19.00 Hz over a number of PTR operating frequencies between about 1.43 Hz and about 1.52 Hz. These show vibrations caused by the twelfth, thirteenth and fourteenth harmonics of the PTR operating frequency and their effect on the vibration caused at the structural resonance at about 19.00 Hz.

Figure 5:
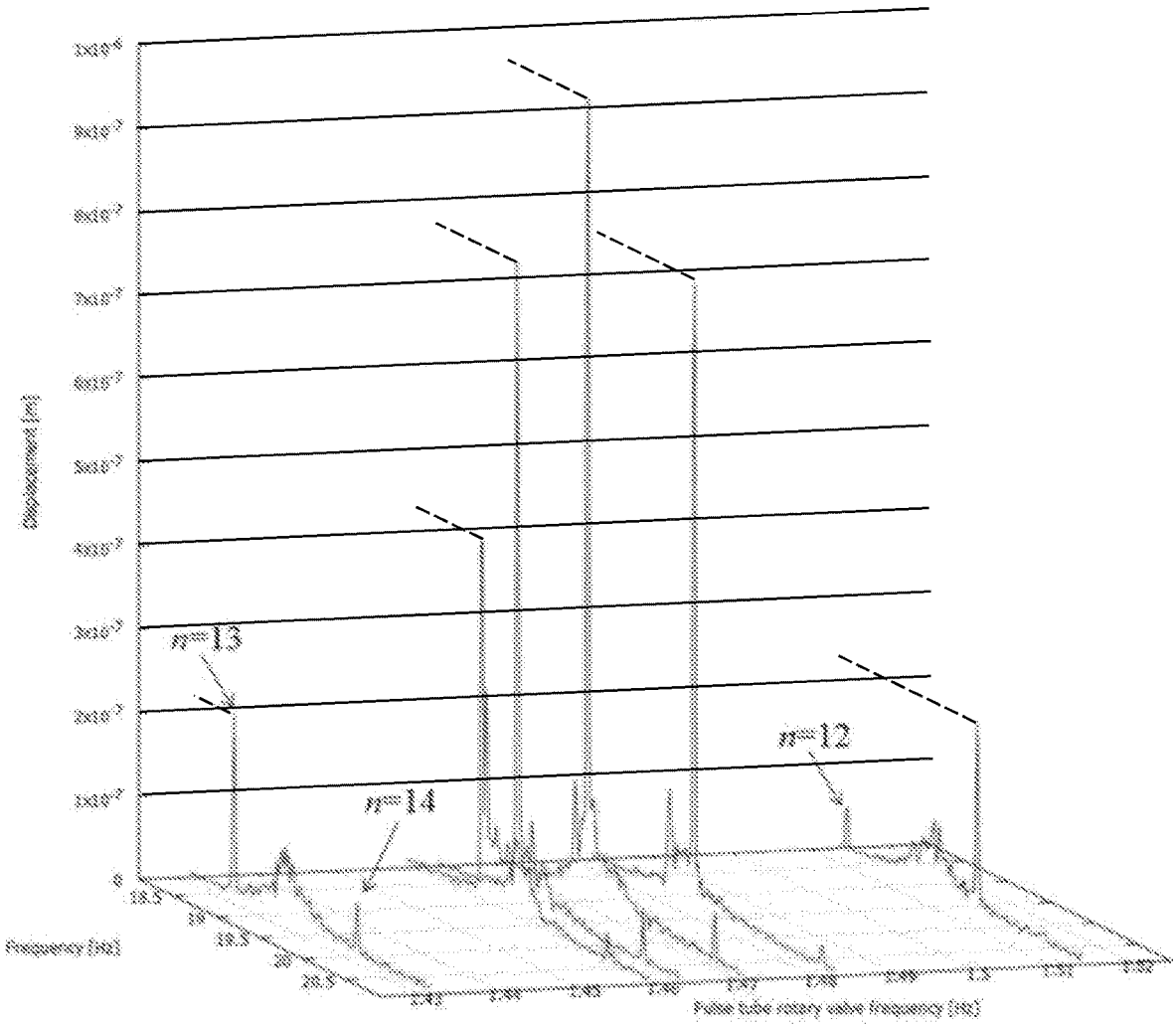
FIG. 5 shows a plot comparing vibration amplitudes across a frequency spectrum at different pulse tube refrigerator operating frequencies.

In FIG. 5, the harmonics of the PTR operating frequency are indicated by the letter "n". This figure shows that the greatest degree of coupling between the thirteenth harmonic and the cryostat structural resonance occurs at an operating frequency of about 1.47 Hz. The vibrations caused by this coupling cause a displacement of greater than 900 nm compared to displacements of about 200 nm when the PTR operating frequency is about 1.43 Hz and about 1.51 Hz. As above, the accelerometer used to collect these readings was installed on the exterior of a top plate of the system, and therefore not in an environment that was cooled or in which a vacuum was applied.

FIG. 5 also shows that shifts in operating frequency of about 0.01 Hz can also have a significant effect. This can be seen by comparing the peak of the plot for a PTR operating frequency of about 1.46 Hz to the peak of the plot for a PTR operating frequency of about 1.47 Hz. At an operating frequency of about 1.46 Hz, the greatest amplitude vibration is about 500 nm less than the greatest amplitude vibration caused when the operating frequency is about 1.47 Hz.

A method of achieving further de-coupling of a harmonic from a structural resonance can be applied in addition to adjusting the operating frequency of the PTR. This additional method is to alter the mass of the cryogenic cooling system since this will affect the frequency of the structural resonances.

Figure 6:
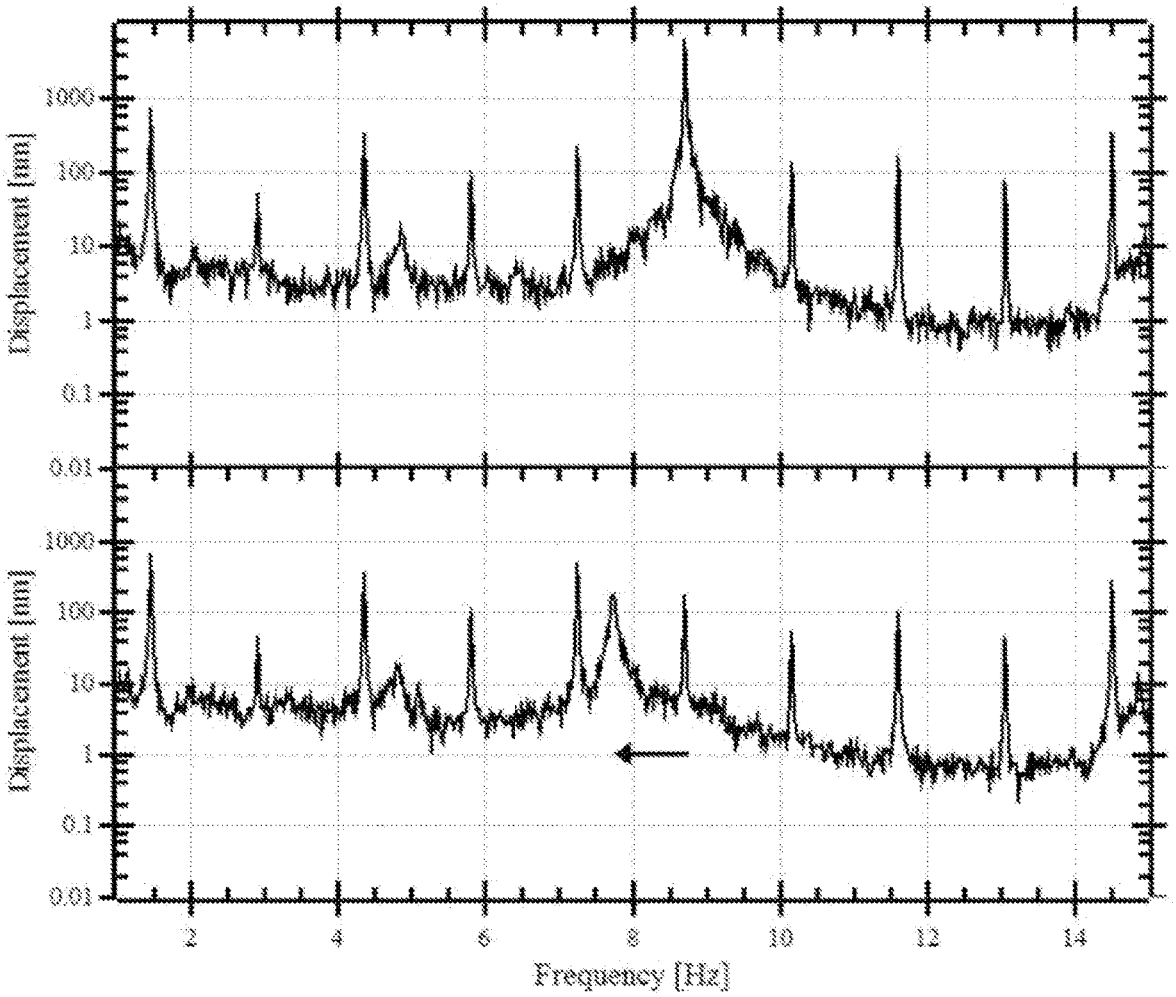
FIG. 6 shows a comparative plot of vibrations in an example cooling system across a frequency spectrum when the mass of the cryogenic cooling system is altered.

FIG. 6 shows the effect on the vibrations in a cryostat where this method is applied. The plot in the upper half of FIG. 6 shows the output of an accelerometer attached to a cryostat to which a PTR is coupled and operating at a frequency of about 1.40 Hz. In the cryostat used for this example, there is a resonance at about 8.60 Hz. In the upper plot of FIG. 6, it can be seen that the resonance at about 8.60 Hz is coupled to one of the harmonics of the PTR operating frequency (each of which are again represented by peaks at regular intervals across the frequency spectrum shown in the figure), which has been amplified.

The lower plot shown in FIG. 6 shows the accelerometer output for same cryostat with the same PTR operating at the same frequency. However, in this plot, the structural resonance is shifted to about 7.60 Hz, which means that it is no longer coupled with a harmonic of the PTR operating frequency. To achieve this, a mass of about 100 kilogrammes (kg) was attached to the cryostat, and has resulted in a reduction in the amplitude of the vibrations in the cryostat.

While this method achieves a reduction in the amplitude of the vibrations, we have discovered that adjusting the operating frequency of the PTR provides a greater flexibility than is possible to achieve using this additional method. This is because each individual cryostat has its own unique structural resonances that are determined by how the cryostat is constructed and the arrangement and mass of its components, which varies (even if only slightly) from system to system. Additionally, anything that is added to a cryostat for an experiment or procedure, such as a sample, changes the frequency of the structural resonance due to the corresponding mass that is added to the cryostat. Since it is not known during the manufacture or installation exactly what a user will add to a cryostat when they use it, it is therefore not possible to accurately de-tune the cryostat by altering the mass of the cryostat, so any additional de-tuning applied by altering the mass of the cryostat has the potential to have a less significant effect than intended once the cryostat is set up as the user wishes.

Returning to the example method of reducing noise and example frequency adjuster, there are two procedures that can be used to achieve the modulation of the operating frequency. The first of these procedures is for a user to review the output of the accelerometer. The controller of the frequency adjuster is then used to adjust the operating frequency of the PTR coupled to the cryostat to which the accelerometer is attached to a suitable frequency based on the accelerometer's output. This is achieved by use of a dial or user interface (not shown) on the controller that is linked to the stepper motor (not shown) that rotates the rotary valve of the PTR causing the rotation rate to be adjusted in response to a corresponding signal from the controller.

The second procedure is an automated procedure where software is used to modulate the PTR operating frequency instead of the user. In this procedure, the output of the accelerometer is analysed using software held by the controller of the frequency adjuster. This identifies peaks caused by vibrations across the frequency spectrum and adjusts the operating frequency of the PTR to a frequency with the lowest or a lower level of vibration using frequency scanning and spectral analysis techniques, such as Fast Fourier Transforms. Of course, in some examples the user is able to override the software to choose an alternative operating frequency for the PTR if desired.

Should there be a part of the cryostat that is considered particularly sensitive to vibrations, or is of greater importance, the accelerometer is able to be placed at that location so that the user is able to focus their efforts of reducing vibrations on that part of the cryostat.

In some examples, a Gifford-McMahon (GM) refrigerator, Stirling cooler or dilution refrigerator, for example operable with a pressure pump and/or a compressing system, is used in place of (or in addition to) a PTR. In a GM refrigerator, the operating frequency of the rotary valve is modulated to reduce the vibrations it generates; in a Stirling cooler, the operating frequency of the pistons is modulated for the same reason; and in a dilution refrigerator, the operating frequency of a pressure pump and/or compressing system coupled to and being used with the dilution refrigerator to assist its operation is modulated for the same reason.

In addition to the operating frequencies set out above, the operating frequency of 3 K mechanical refrigerators used in examples described herein, most "higher power" refrigerators (in other words those considered to be able to cool to temperatures as low as 3 K or lower and/or with a cooling power considered to be high) all have operating frequencies of about 1 Hz to 2 Hz. Some specialised 3 K coolers (for example those used for space applications) operate at higher frequencies of typically tens or even hundreds of Hertz.

What is claimed is:

1. A method of reducing noise in a cryogenic cooling system, the method comprising:

monitoring vibrations in the cryogenic cooling system during operation of only a single mechanical refrigerator;

measuring vibration amplitudes in the monitored vibrations;

determining transfer functions and structural resonance coupling for the cryogenic cooling system based on the measured vibration amplitudes; and modulating an operating frequency of the mechanical refrigerator based on the determined transfer functions and structural resonance coupling so as to reduce the vibration amplitudes of the monitored vibrations.

2. The method according to claim 1, wherein modulating the operating frequency comprises adjusting the operating frequency of the mechanical refrigerator from a first frequency to a second frequency.

3. The method according to claim 1, wherein modulating the operating frequency of the mechanical refrigerator comprises modulating the operating frequency of a driving motor of the mechanical refrigerator.

4. The method according to claim 3, wherein the driving motor is a stepper motor.

5. The method according to claim 4, wherein the step rate of the stepper motor is controllable.

6. The method according to claim 3, wherein the driving motor drives a rotary valve of the mechanical refrigerator during the operating of the mechanical refrigerator.

7. The method according to claim 6, wherein the operating frequency is the frequency at which the rotary valve rotates when in use.

8. The method according to claim 1, wherein the operating frequency is between 1.20 Hertz (Hz) and 1.90 Hz, and preferably the operating frequency is between 1.30 Hz and 1.50 Hz.

9. The method according to claim 1, wherein the mechanical refrigerator is a Pulse Tube refrigerator.

10. The method according to claim 1, wherein the operating frequency is modulated by a user based on the monitored vibrations.

11. The method according to claim 1, wherein the operating frequency is modulated automatically based on the monitored vibrations.

12. The method according to claim 1, wherein the vibrations are monitored by a probe placed in contact with the cooling system.

13. The method according to claim 12, wherein the probe is placed in contact with a cryostat comprised by the cooling system.

14. The method according to any one of claim 1, wherein the vibrations are monitored by a probe placed in contact with a cooling target of the cooling system.

15. The method according to claim 12, wherein the probe is an accelerometer.

16. The method according to claim 1, wherein the operating frequency of the mechanical refrigerator is modulated to de-couple at least one harmonic of the operating frequency from a structural resonance of the cooling system.

17. The method according to claim 16, wherein the at least one harmonic of the operating frequency and the structural resonance of the cooling system are de-coupled by adjusting the operating frequency of the mechanical refrigerator, and preferably the operating frequency is adjusted by at least 0.01 Hz.

18. A frequency adjuster, comprising:

a vibration detector adapted in use to:

monitor vibrations associated with only a single mechanical refrigerator in a cryogenic cooling system; and measure vibration amplitudes in the monitored vibrations; and a controller adapted to:

determine transfer functions and structural resonance coupling for the cryogenic cooling system based on the measured vibration amplitudes; and control an operating frequency of the mechanical refrigerator based on the determined transfer functions and structural resonance coupling so as to reduce the vibration amplitudes of the monitored vibrations.

19. The method of claim 1, wherein the transfer functions and structural resonance coupling for the cryogenic cooling system are transfer functions and structural resonance coupling for the cryogenic cooling system and components attached to the cryogenic cooling system.

20. A cryogenic cooling system comprising:

a cryostat;

a mechanical refrigerator coupled to said cryostat; and a frequency adjuster according to claim 18 adapted in use to monitor vibrations in the cryostat and modulate an operating frequency of the mechanical refrigerator.

* * * * *